US005618037A

United States Patent [19]

Chang et al.

[11] Patent Number: 5,618,037

[45] Date of Patent: Apr. 8, 1997

[54] METHOD FOR MAINTAINING MAILPIECE INTEGRITY

[75] Inventors: Sung S. Chang, Stamford; James L. Harman, Southport; Gary S. Jacobson, East Norwalk; Wesley A. Kirschner; Michael J. Ramadei, both of Trumbull; Eric L. Zuidema, Norwalk, all of Conn.

[73] Assignee: Pitney Bowes Inc.World Headquarters, Stamford, Conn.

[21] Appl. No.: 446,162

[22] Filed: May 22, 1995

[51] Int. Cl.[6] ..... B65H 7/02

[52] U.S. Cl. ..... 271/258.02; 271/258.04; 271/259

[58] Field of Search ..... 271/258.02, 258.01, 271/258.04, 259; 270/58.06, 52.04, 58.23

[56] References Cited

U.S. PATENT DOCUMENTS

| | | | |
|---|---|---|---|
| 3,626,956 | 12/1971 | Sauder | 271/259 X |
| 4,327,993 | 5/1982 | Gauronski et al. | 355/3 |
| 4,799,661 | 1/1989 | Nail | 271/258.01 X |
| 5,314,566 | 5/1994 | Gallagher et al. | 271/259 X |
| 5,380,109 | 1/1995 | Eckert, Jr. et al. | 271/258.01 X |

FOREIGN PATENT DOCUMENTS

| | | | |
|---|---|---|---|
| 2230493 | 9/1990 | Japan | 271/258.01 |

*Primary Examiner*—David H. Bollinger
*Attorney, Agent, or Firm*—Ronald Reichman; Brigitte L. Jeffery; Melvin J. Scolnick

[57] ABSTRACT

A method for maintaining mailpiece integrity in a mailing system when a mechanical module experiences an error. For one category of errors, the mailing system may automatically recover from the error without operator intervention. For the remaining category of errors, the mailing system may recover from the error with minimum operator intervention, that is, the operator may be required to only remove the error producing mailpiece. A motion control processor for an error producing mechanical module will report a fault to its corresponding mailpiece builder task and the error detector task. Movement of at least the error producing mailpiece shall stop. The fault will be reported to the mailpiece builder tasks corresponding to the mechanical modules having no error condition. The mailing system shall suspend further processing of mailpieces upstream from the error producing mailpiece. For one category of errors, the mailing system will purge the error producing mailpiece from the error producing module without operator intervention. For the remaining category of errors, the operator will be required to remove at least the error producing mailpiece. State machines are then selected to perform system wide job recovery.

13 Claims, 6 Drawing Sheets

METHOD FOR MAINTAINING MAILPIECE INTEGRITY

BACKGROUND OF THE INVENTION

The subject invention relates to a method for maintaining mailpiece integrity in a mailing machine which assembles the mailpiece. More particularly, it relates to a method for automatically recovering from mechanical errors in a mailing machine without operator intervention.

Mailing machines that assemble a plurality of documents for insertion into an envelope are known in the art. Such machines typically comprise: feeder modules for feeding sheets into a mailpiece, envelope modules for feeding an envelope, and inserter modules for inserting mailpieces into the envelope. In using mailing machines, there are various types of errors that can occur. The difficulty of correcting the error and maintaining the integrity of the mailpiece poses a serious problem. The error becomes further complicated if the mailing machine job consists of a matched mail application wherein identification codes on a control document are compared with identification codes on inserted documents to assure that documents are properly matched. In prior art mailing machines, mailpiece integrity was maintained during error recovery by requiring the operator to remove all mailpieces in process from the mailing machine. Operator intervention to correct the errors was often extensive, time consuming, and produced a waste of paper.

Definition

As used herein, the following terms have the meaning set forth.

Segment: A data element including identification of the motor, solenoid, or sensor effected by the segment command (if any); a command to be executed by the motion control processor during the segment, and any information required for execution of the segment command.

Profile: A sequence of segments whose execution by a motion control processor controls a mechanical system to carry out a corresponding mechanical function.

Mailpiece attribute: a data element defining a physical characteristic of a mailpiece generated by a mechanical system.

Job attribute: a data element defining instructions for system wide handling of all pieces in a job run.

SUMMARY OF THE INVENTION

It is an object of the subject invention to provide an efficient, automatic jam recovery method that eliminates the need for operator intervention.

It is a further object of the subject invention to provide such an automatic jam recovery method having automatic diversion of an error producing mailpiece for greater convenience and integrity as well as increased throughput.

It is still a further object of the subject invention to provide a method for monitoring the presence of all mailpieces in the mailing system during jam recovery.

It is still another object of the subject invention to provide a method for maintaining mailpiece integrity between a concurrently generated addressed envelope and its personalized contents without the need to mark and scan these individualized items.

These and other objects and advantages as will appear hereinafter are attained in a novel method for maintaining mailpiece integrity in a mailing system when a mechanical module experiences an error. For one category of errors, the mailing system may automatically recover from the error without operator intervention. For the remaining category of errors, the mailing system may recover from the error with minimum operator intervention, that is, the operator may be required to only remove the error producing mailpiece. A motion control processor for an error producing mechanical module will report a fault to its corresponding mailpiece builder task and the error detector task. Movement of at least the error producing mailpiece shall stop. The fault will be reported to the mailpiece builder tasks corresponding to the mechanical modules having no error condition. The mailing system shall suspend further processing of mailpieces upstream from the error producing mailpiece. For one category of errors, the mailing system will purge the error producing mailpiece from the error producing module without operator intervention. For the remaining category of errors, the operator will be required to remove at least the error producing mailpiece. State machines are then selected to perform system wide jam recovery.

DESCRIPTION OF THE PREFERRED EMBODIMENT

Figure 1:
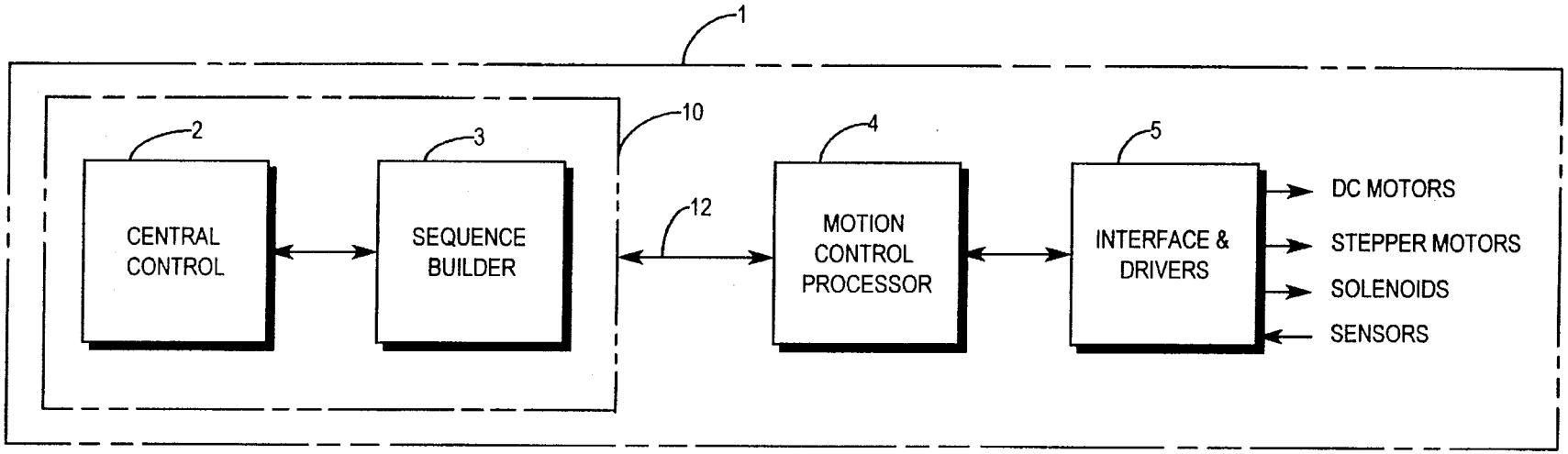
FIG. 1 is a schematic block diagram of an apparatus for maintaining mailpiece integrity in accordance with the subject invention.

As shown in FIG. 1, a mailing system 1 in accordance with the subject invention has a central control process 2 and a sequence builder process 3 running on host processor 10. A motion control processor 4 is connected to host processor 10 through communications link 12 for transmission of messages between host processor 10 and motion control processor 4. Communications link 12 may be any suitable communications link having the necessary communications capacity for the subject invention. Host processor 10 is preferably an Intel 80386 processor and will determine the motion control requirements to be communicated to motion control processor 4. A preferred embodiment of the motion control processor 4 is described in commonly assigned, co-pending U.S. application Ser. No. 08/327,246 filed Oct. 24, 1994, which is hereby incorporated by reference.

Interface and drivers 5 comprises circuitry which converts the digital output of motion control processor 4 into control signals having the proper waveform and timing; to control a mailing system. Details of the design of interface and drivers 5 will of course depend upon the processor selected as motion control processor 4. Such design would be a matter of routine for a person of ordinary skill in the art and need not be discussed further here for an understanding of the subject invention. Generally, in the subject invention, interface and drivers 5 will output control signals to DC motors, stepper motors, and solenoids and receive status signals from sensors in the mailing system.

Figure 2:
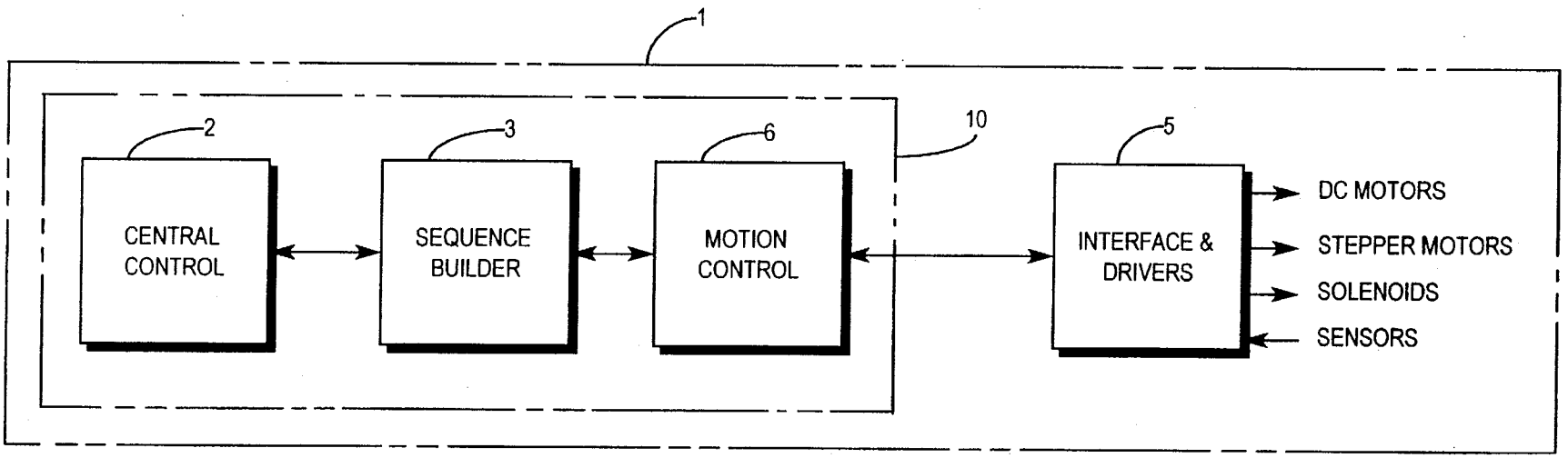
FIG. 2 is a schematic block diagram of an alternate embodiment of the apparatus for maintaining mailpiece integrity in accordance with the subject invention.

FIG. 2 shows an alternative embodiment of a mailing system 1 in accordance with the subject invention. In this configuration, the motion control requirements are handled by a motion control process 6 which resides in host processor 10. This flexible architecture enables the host processor 10 to implement the subject invention in a single processor environment yet maintain mailpiece integrity without the need for a dedicated motion control processor.

Figure 3:
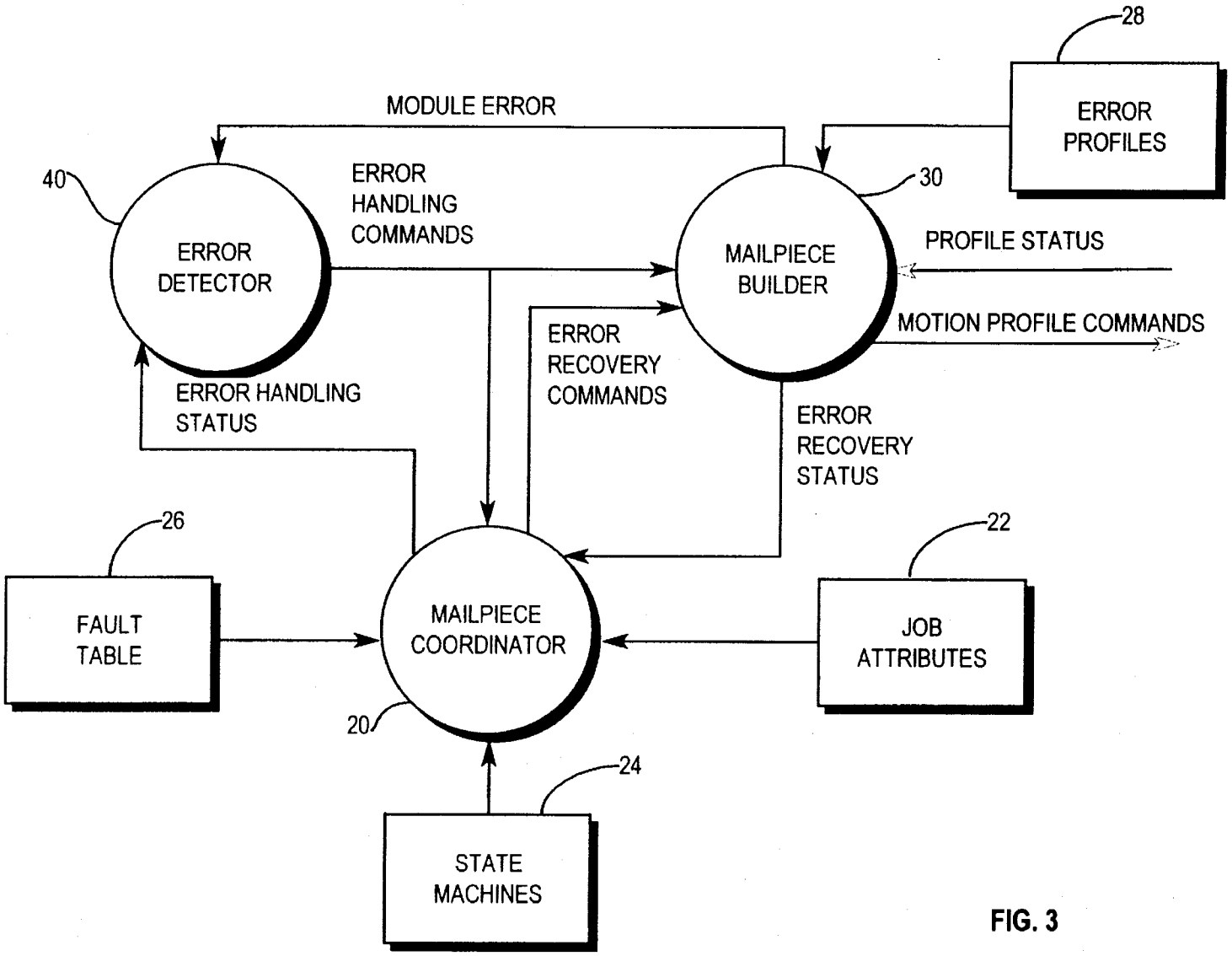
FIG. 3 is a representation of relationships between tasks performed by the host computer used in the apparatus of FIG. 1.

Referring to FIG. 1 and FIG. 3, central control process 2 includes the mailpiece coordinator subprocess 20 which tracks the processing order of a mailpiece in the mailing system and the error detector subprocess 40 which maintains mailpiece integrity in the event the mailing system 1 experiences a fault. The sequence builder process 3 includes the mailpiece builder 30 which determines motion control requirements for each mailpiece. In a mailing system 1 with a plurality of mechanical modules, the host computer 10 runs a mailpiece builder 30 for each mechanical module. Details of using the mailpiece coordinator 20 and mailpiece builder 30 to generate a mailpiece are provided in commonly assigned patent application Ser. No. 08/421,120 to Chang et al., filed Apr. 13, 1995, which is hereby incorporated by reference.

Referring to FIG. 3, error detector 40 maintains mailpiece integrity in the event the mailing system 1 experiences a mechanical error. Fault codes for mechanical errors are stored in fault table 26. The mailpiece coordinator 20 looks up the reported fault code in table 26 to determine whether the error may be cleared without operator intervention.

Based upon the type of reported error, the mailpiece builder 30 selects error profiles 28 for motion control processor 4 to control stopping mailpieces in the mechanical module. The mailpiece builder 30 then reports a module error to error detector 40. In the subject invention, when a mechanical error occurs, the mailing system shall process any mailpieces downstream from the error producing mailpiece that are capable of being completed. Items upstream from the error producing mailpiece are placed in a suspended state pending initiation of the jam recovery procedure.

Job attributes 22 define the jam recovery procedure that applies to all mailpieces in a job run. The job attributes 22 include user definable error recovery parameters such as whether the error producing mailpiece should be regenerated, and whether it is necessary to maintain the sequence and postal code grouping of the mailpieces produced. In addition, the job attributes 22 may indicate that the mailing system operates in a secure mode, that is, the mailing system 1 constructs one mailpiece at a time for maximum mailpiece integrity. In a non-secure mode, the mailing system 1 is capable of maintaining mailpiece integrity without printing identification codes on a mailpiece or scanning identification information from the mailpiece, even with multiple mailpieces in process.

Based upon job attributes 22, the mailpiece coordinator 20 will select an appropriate state machine 24 to perform the error recovery. State machines 24 used in a preferred embodiment of the subject invention are set forth in Table I.

TABLE I

| STATE MACHINE | COMMENT |
|---|---|
| BASIC_RESTART | Instructs the envelope printer to ignore existing data. The central control process assumes the mailing machine is empty and can start producing mailpieces, i.e., resume normal processing. |
| REJECT_RESTART | Outsorts any envelopes left in the mailing machine then performs BASIC_RESTART. |
| ENVELOPE_RESTART | Generates corresponding documents for select envelopes remaining in the mailing machine. Determines where mailpieces are located in the mailing machine, rejects any remaining envelopes, and performs BASIC_RESTART. |
| CANCEL_JOB | Empties the entire mailing machine of all documents and envelopes. Resets envelope printer, cancels the job, then enters an idle state. |
| NO_RECOVERY_REQUIRED | The mailpiece coordinator enters an idle state. |
| NO_REGENERATION | Deletes any data for documents that were produced, clears the mailing machine, and performs BASIC_RESTART. |
| AUTO_INSERTER_RECOVERY | Clears all documents from mailing machine. Determines the location of mailpieces then performs ENVELOPE_RESTART. |
| CLEAR_MACHINE_RESTART | Clears the mailing machine and performs BASIC_RESTART. Maintains data. |

TABLE I-continued

| STATE MACHINE | COMMENT |
|---|---|
| ABSORB_SHEETS_EMPTY_MACHINE | Absorbs extra sheets when paper supply in printer is depleted. Clears all documents from the mailing machine and performs BASIC_RESTART. |
| ABSORB_SHEETS_RESTART | Absorbs sheets, clears documents from the mailing machine, and performs ENVELOPE_RESTART. |

Figure 4:
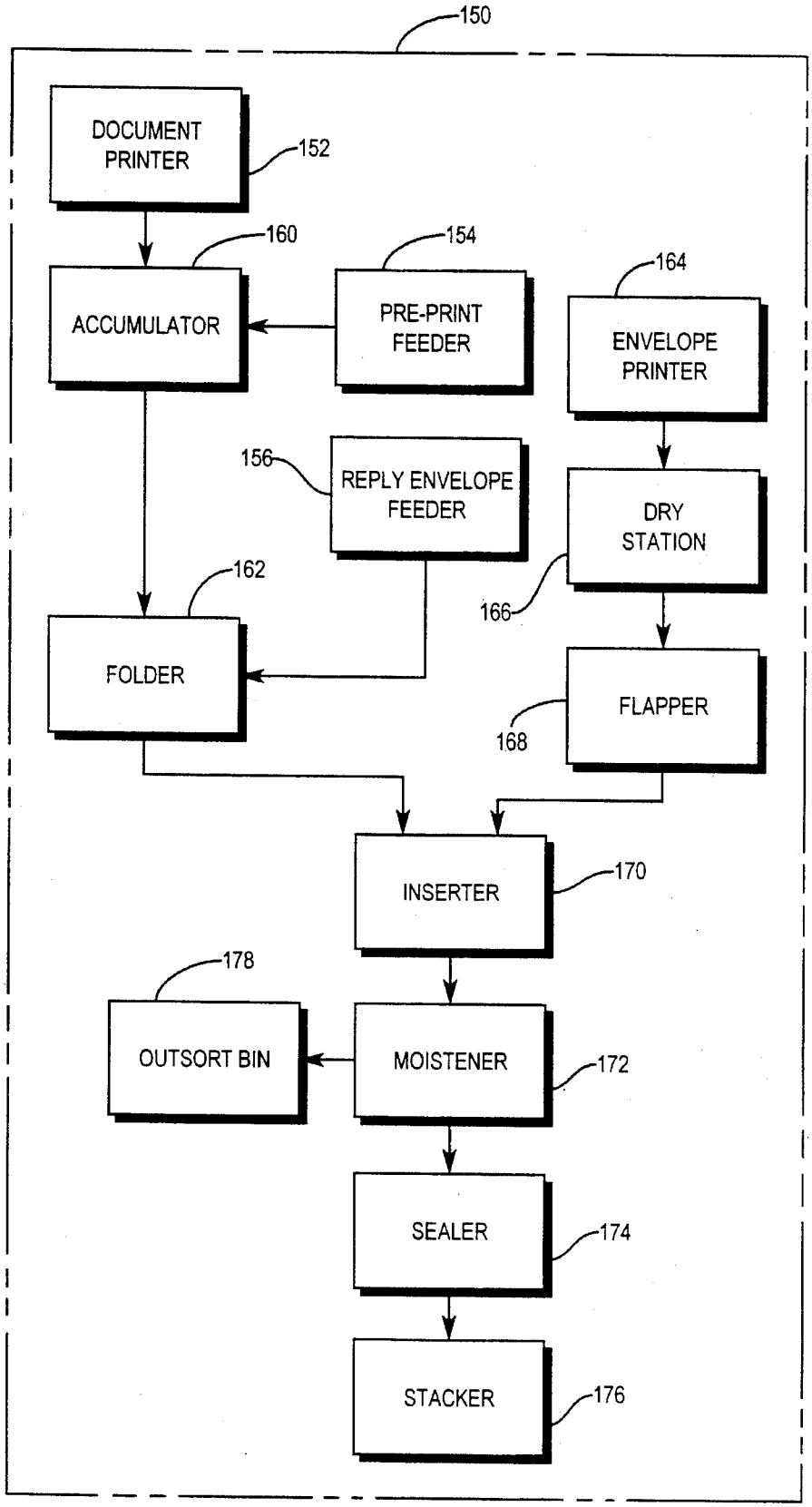
FIG. 4 is a schematic block diagram of a mailing system employing the subject invention.

FIG. 4 illustrates a mailing system 150 which may employ the subject invention. System 150 includes the following mechanical modules: document printer 152, pre-print feeder 154, reply envelope feeder 156, accumulator 160, folder 162, envelope printer 164, envelope buffer 166, flapper 168, inserter 170, moistener 172, sealer 174, stacker 176, and outsort bin 178. The types of mechanical errors supported by the error detector task 40 include a jam in the inserter 170, failure to open an envelope flap in the flapper 168, and failure to open the envelope body in the inserter 170. For these error conditions, the mailpiece coordinator 20, mailpiece builder 30, and error detector 40 cause the system 150 to divert the error producing mailpiece to the outsort bin 178 and automatically recover from the error without operator intervention. For all other types of mechanical errors, including power failure, interlock open, and misfeeds from the pre-print feeder 154, the reply envelope feeder 156, or dry station 166, operator intervention is required to remove the error producing mailpieces and/or clear the fault.

Figure 5:
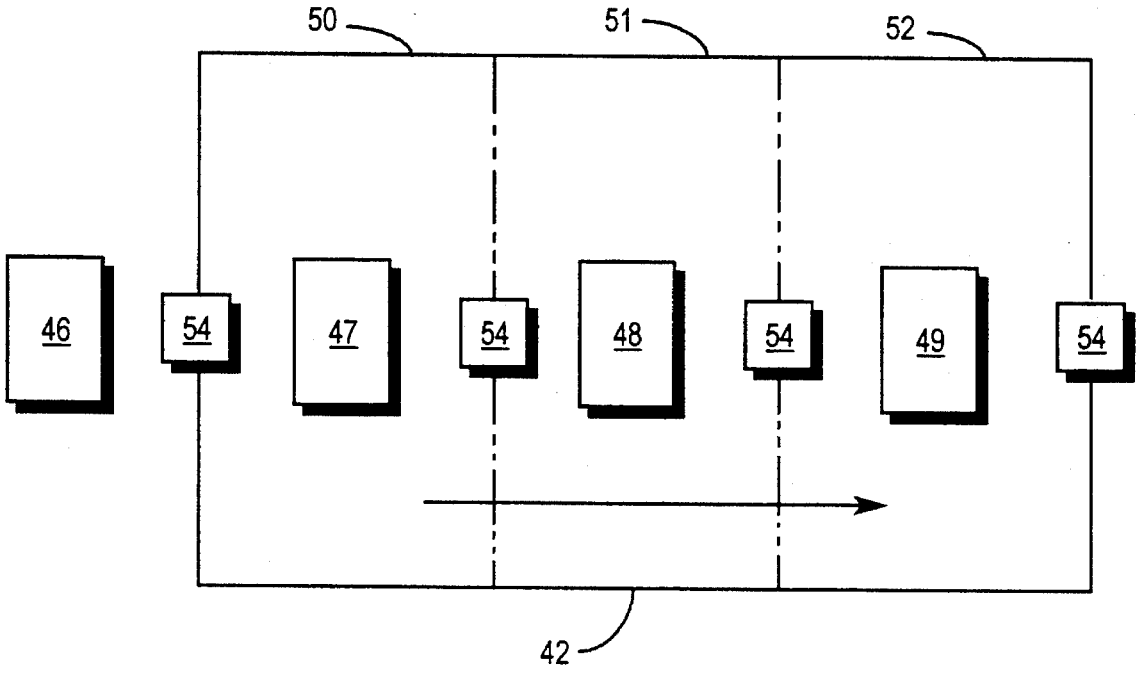
FIG. 5 illustrates a mechanical module having a plurality of stages for monitoring the mailpieces.

FIG. 5 illustrates a mechanical module 42 that may be used in a mailing system 1, 150 operating in a normal mode. A transport belt (not shown) feeds the mailpieces 46, 47, 48, 49 in the direction indicated by the arrow. Mailpieces in the subject invention are monitored in a plurality of stages 50, 51, 52. These stages 50, 51, 52 permit the mailing system 1 to control the integrity of a plurality of mailpieces 46, 47, 48, 49 without the need to place identification codes on the mailpieces. Each stage 50, 51, 52 has a plurality of sensors 54 for detecting leading and trailing edges of a mailpiece entering or exiting a stage 50, 51, 52. A mailpiece must vacate a stage 50, 51, 52 before a sequential mailpiece 46, 47, 48 enters the stage. Under error conditions, the mailpiece builder 30 selects error profiles 28 which will cause profiles executed by the motion control processor 4 to control stopping mailpieces 46, 47, 48, 49 in each stage 50, 51, 52 of the module 42 so that each mailpiece 46, 47, 48, 49 is brought to rest underneath a sensor 54 thereby enabling error detector 40 to determine the location of mailpieces 46, 47, 48, 49 in the mailing system 150.

Figure 6:
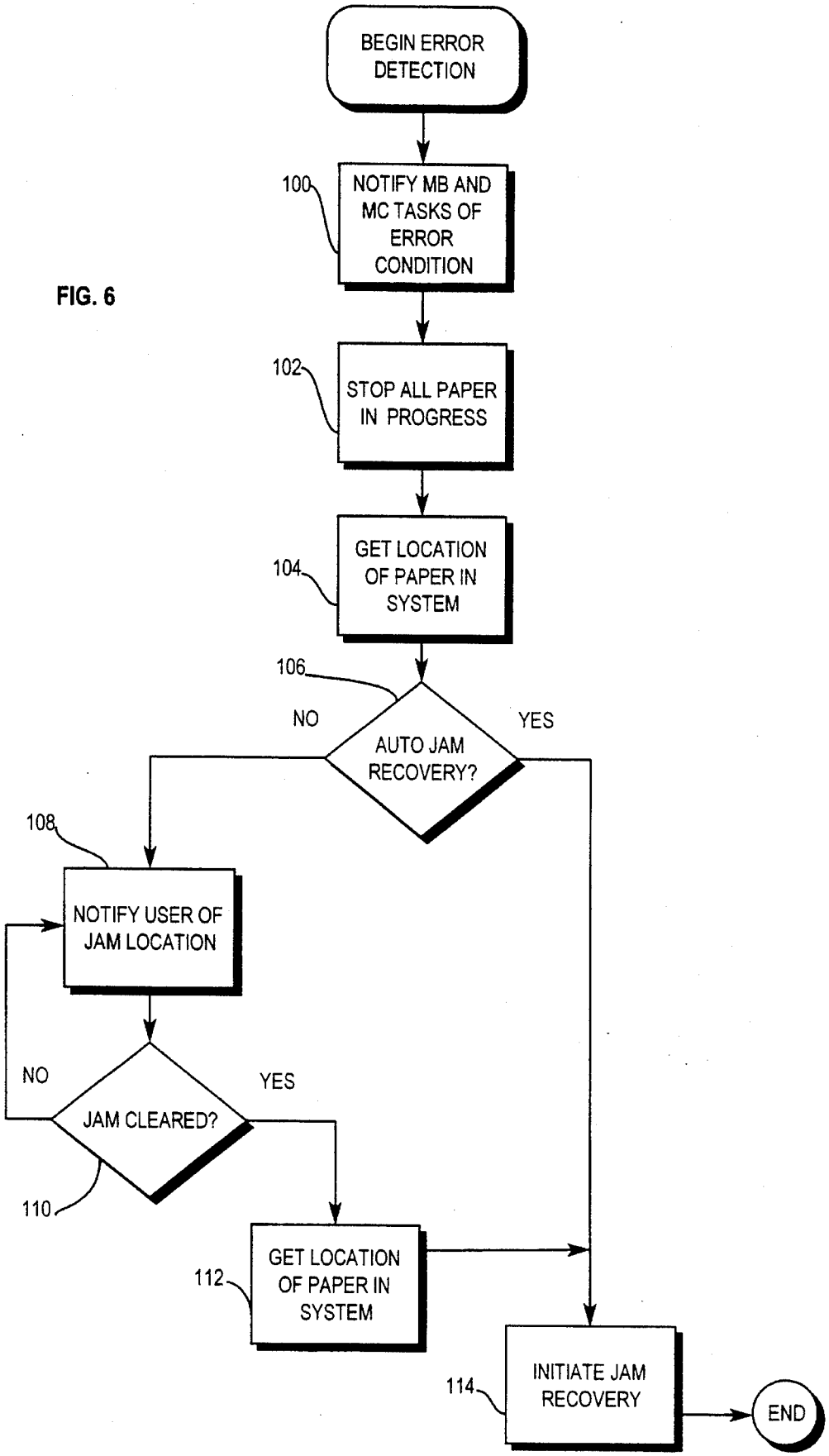
FIG. 6 is a flow diagram for the error detector task shown in FIG. 3.

FIG. 6 shows a flow diagram of the operation of the error detector subprocess 40. At step 100, error detector 40 reports an error to the mailpiece coordinator 20. In addition, error detector 40 reports the error to the mailpiece builder 30 for each of the mechanical modules. At step 102, mailpieces that may be in progress in other mechanical modules are brought to a controlled stop underneath a sensor 54. At step 104, the location of all mailpieces in the system 1 is determined by checking the status of sensors 54. At decision block 106, if the error may be cleared automatically, the mailing system 1 initiates jam recovery procedures at step 114 without manual intervention. If the error requires manual intervention, at step 108, the operator is notified of the error location. The operator should only remove the mailpiece at the designated error location. At decision block 110, the status of sensors 54 is checked to determine if the error producing mailpiece has been removed. If not, the mailing system 1 waits until such action is initiated by the user. If the error producing mailpiece has been removed, at step 112, the location of all mailpieces in the mailing system 1 is again checked to ensure the operator did not remove additional mailpieces. A check is also performed at step 112 on the toner, pre-print insert, document, and envelope supply levels. If additional mailpieces are unintentionally removed, the mailing system 1, at step 114, will modify the jam recovery procedures to respond to the operator introduced error.

The subject invention is particularly suited for matched mail applications where a mailing system 1 generates an addressed envelope and its corresponding personalized documents without marking or scanning the mailpiece. To assist those skilled in the art in understanding how the subject invention automatically recovers from an error while maintaining mailpiece integrity, set forth below, by way of example only, is pseudocode such as could be used to implement the method of the present invention in system 150.

```
IF inserter jam occurs
    Report jam to mailpiece builder, error detection, and
    mailpiece coordinator;
    Reject error producing mailpiece;
    Stop printing;
    Stop upstream mailpieces so that each mailpiece
    occupies a single stage of a mechanical module;
    Continue processing downstream mailpieces;
    Load TIMER;
        FOR TIMER > 0
            Query Mailpiece Builder for status report;
            IF Status = paper moving
                Reset TIMER;
            END
        END
    Query Mailpiece Builder to get location of mailpieces;
    Execute AUTO_INSERTER_RECOVERY state
    machine;
END
```

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. In a mailing machine having a plurality of mechanical modules for producing a plurality of mailpieces, without printing codes on the mailpieces, a method for automatically recovering from an error, without operator intervention, in a mechanical module comprising the steps of:

a) receiving a fault code from an error producing module;

b) stopping movement of at least one mailpiece in the error producing module;

c) reporting the fault code to a mailpiece builder to control a plurality of mechanical modules having no error condition;

d) purging an error producing mailpiece from the error producing module without operator intervention;

e) suspending further processing of a plurality of mailpieces upstream from the error producing mailpieces; and, f) selecting a state machine to perform a jam recovery in the plurality of mechanical modules.

2. The method of claim 1 wherein the step of suspending comprises stopping movement of the plurality of mailpieces within the plurality of mechanical modules having no error condition.

3. The method of claim 1 further comprising the step of detecting the plurality of mailpieces in the plurality of mechanical modules.

4. The method of claim 3 further comprising the step of processing a plurality of mailpieces downstream from the error producing mailpiece prior to purging the error producing mailpiece from the error producing module.

5. In a mailing machine having a plurality of mechanical modules for producing a plurality of mailpieces, without printing codes on the mailpieces, a method for recovering from an error in a mechanical module comprising the steps of:

a) receiving a fault code from an error producing module;

b) stopping movement of at least one mailpieces in the error producing module;

c) reporting the fault code to a mailpiece builder to control a plurality of mechanical modules having no error condition;

d) indicating the error producing module;

e) detecting the plurality of mailpieces in the plurality of mechanical modules;

f) removing an error producing mailpiece from the error producing module;

g) repeating step (e);

h) suspending further processing of a plurality of mailpieces upstream from the error producing mailpiece; and, i) selecting a state machine to perform a jam recovery in the plurality of mechanical modules for the received fault code.

6. The method of claim 5 wherein the step of suspending comprises stopping movement of the plurality of mailpieces within the plurality of mechanical modules having no error condition.

7. The method of claim 5 further comprising the step of processing a plurality of mailpieces downstream from the error producing mailpiece prior to purging the error producing mailpiece from the error producing module.

8. In a mailing machine having a plurality of mechanical modules for producing a plurality of mailpieces, without printing codes on the mailpieces, the mailing machine including a document printer for printing a plurality of personalized documents, the mailing machine also included an envelope printer for printing a plurality of addressed envelopes corresponding to the plurality of personalized documents, a method for automatically recovering, without operator intervention, from an error in a mechanical module containing a personalized document comprising the steps of:

a) receiving a fault code from an error producing module;

b) stopping movement of at least one mailpiece in the error producing module;

c) reporting the fault code to a mailpiece coordinator to control a plurality of mechanical modules having no error condition;

d) purging an error producing personalized document from the error producing module without operator intervention;

e) purging the addressed envelope corresponding to the error producing personalized document without operator intervention.

9. The method of claim 8 further comprising the step of regenerating the error producing personalized document and the addressed envelope corresponding to the error producing personalized document.

10. In a mailing machine having a plurality of mechanical modules for producing a plurality of mailpieces, without printing codes on the mailpieces, the mailing machine including a document printer for printing a plurality of personalized documents, the mailing machine also including an envelope printer for printing a plurality of addressed envelopes corresponding to the plurality of personalized documents, a method for recovering from an error in a mechanical module containing a personalized document comprising the steps of:

a) receiving a fault code from an error producing module;

b) stopping movement of at least one mailpiece in the error producing module;

c) reporting the fault code to a mailpiece builder or mailpiece coordinator to control a plurality of mechanical modules having no error condition;

d) indicating the error producing module;

e) detecting the plurality of mailpieces in the plurality of mechanical modules;

f) removing an error producing personalized document from the error producing module;

g) repeating step (e)

h) suspending further processing of a plurality of mailpieces upstream from the error producing mailpiece; and, i) selecting a state machine to perform a jam recovery in the plurality of mechanical modules for the received fault code.

11. The method of claim 10 further comprising the steps of purging the addressed envelope corresponding to the error producing personalized document, without operator intervention, and regenerating the error producing personalized document and the addressed envelope corresponding to the error producing personalized document.

12. An improved mailing system having a host computer executing a plurality of tasks, the tasks including a mailpiece coordinator task for monitoring the generation of a plurality of mailpieces, requiring no printing of codes on each mailpiece, and a plurality of simultaneously executing mailpiece builder tasks for determining the motion control requirements for the plurality of mailpieces in which each of the plurality of mailpiece builder tasks corresponds to a mechanical module in the mailing system, wherein the improvement comprises:

a) an error coordinator task for maintaining mailpiece integrity when the mailing system experiences a mechanical error;

b) means for selecting a set of error profiles for stopping the mailpieces when the mailing system experiences the error; and c) means for defining a jam recovery procedure for the plurality of mailpieces when the mailing system experiences the error.

13. An apparatus as described in claim 12 wherein the error coordinator task monitors a plurality of stages in each mechanical module so that no more than one mailpiece occupies each stage.

* * * * *